United States Patent [19]

Narayanan et al.

[11] Patent Number: 4,735,774

[45] Date of Patent: Apr. 5, 1988

[54] ALUMINUM-LITHIUM ALLOY (4)

[75] Inventors: G. Hari Narayanan, Seattle; William E. Quist, Redmond; R. Eugene Curtis, Issaquah, all of Wash.

[73] Assignee: The Boeing Company, Seattle, Wash.

[21] Appl. No.: 567,355

[22] Filed: Dec. 30, 1983

[51] Int. Cl.[4] ..... C22C 21/00

[52] U.S. Cl. ..... 420/533; 420/534; 420/535; 420/542; 420/543; 420/544; 148/417

[58] Field of Search ..... 420/529, 533, 534, 535, 420/537, 542, 543, 544, 549; 148/416, 417

[56] References Cited

U.S. PATENT DOCUMENTS

| | | | |
|---|---|---|---|
| 2,381,219 | 8/1945 | Le Baron | 420/529 |
| 3,346,370 | 10/1967 | Jagaciak | 420/529 |

FOREIGN PATENT DOCUMENTS

| | | | |
|---|---|---|---|
| 8502416 | 6/1985 | France | 420/533 |
| 0787665 | 12/1957 | United Kingdom | 420/529 |
| 1387586 | 3/1975 | United Kingdom | 420/529 |
| 2115836 | 9/1983 | United Kingdom | 420/533 |
| 2121822 | 1/1984 | United Kingdom | 420/533 |
| 2137227 | 10/1984 | United Kingdom | 420/533 |

OTHER PUBLICATIONS

Starke, Jr., E. A. et al., "New Approaches to Alloy Development in the Al-Li System", Journal of Metals, Aug. 1981.

Lewis, R. E. et al., "Aerospace Structural Applications of Rapidly Solidified Aluminum-Lithium Alloys", Jul. 1983.

Peel, C. J. et al., "The Development and Application of Improved Aluminum-Lithium Alloys", 1983.

Quist, W. E. et al., "Aluminum-Lithium Alloys for Aircraft Structure-An Overview", Dec. 1983.

M. V. Hyatt, "Program to Improve the Fracture Toughness and Fatigue Resistance of Aluminum-Sheet and Plate for Airframe Applns", Technical Report, AFML-TR-73-224, Air Force Material Laboratory, Wright Patterson Air Force Base, Ohio, Sep. 1973.

D. J. Chellman and G. G. Wald, "Age Hardening Behavior of Al-Li-(Cu)-(Mg)-Zr P/M Alloys", Proceedings of the 1982 National Powder Metallurgy Conference, May 24-27, 1982, Quebec, Canada, *Progress in Powder Metallurgy* 38:361-381, published in 1983.

I. G. Palmer, R. E. Lewis et al., "Effect of Processing Variables on Microstructure and Properties of Two Al-Li-Cu-Mg-Zr Alloys", Proceedings of the Second International Aluminum-Lithium Conference, Apr. 12-14, 1983, Monterey, California, *Aluminum-Lithium Alloys II*, E. A. Stark, Jr., and T. H. Sanders, Jr., (Eds.), The Metallurgical Society of AIME, Warrendale, PA, pp. 91-110, published in 1984.

*Primary Examiner*—L. Dewayne Rutledge
*Assistant Examiner*—Deborah Yee
*Attorney, Agent, or Firm*—Christensen, O'Connor, Johnson & Kindness

[57] ABSTRACT

An aluminum-lithium alloy exhibiting good fracture toughness and relatively high strength has a nominal composition of 2.5 percent lithium, 1.0 percent magnesium, 1.6 percent copper, 0.12 percent zirconium with the balance being aluminum and trace elements.

10 Claims, No Drawings

ALUMINUM-LITHIUM ALLOY (4)

BACKGROUND OF THE INVENTON

The present invention relates to aluminum-lithium alloys and more particularly to an aluminum-lithium alloy composition with high fracture toughness and high strength.

It has been estimated that current large commerical transport aircraft may be able to save from 15 to 20 gallons of fuel per year for every pound of weight that can be saved when building the aircraft. Over the projected 20 year life of an airplane, this savings amounts to 300 to 400 gallons of fuel. At current fuel costs, a significant investment to reduce the structural weight of the aircraft can be made to improve overall economic efficiency of the aircraft.

The need for improved performance in aircraft of various types can be satisfied by the use of improved engines, improved airframe design, and improved or new structural materials in the aircraft. Improvements in engines and aircraft design have generally pushed the limits of these technologies. However, the development of new and improved structural materials is now receiving increased attention, and is expected to yield further gains in performance.

Materials have always played an important role in dictating aircraft structural concepts. In the early part of this century, aircraft structure was composed of wood, primarily spruce, and fabric. Because shortages of spruce developed in the early part of the century, lightweight metal allows began to be used as aircraft structural materials. At about the same time, improvements in design brought about the development of the all metal cantilevered wing. It was not unitl the 1930's, however, that the metal skin wing design became standard, and firmly established metals, primarily aluminum alloys, as the major airframe structural material. Since that time, aircraft structural materials have remained remarkably consistent with aluminum structural materials being used primarily in the wing, body and empennage, and with steel comprising the material for the landing gear and certain other speciality applications requiring very high strength materials.

Several new materials are currently being developed for incorporation into aircraft structure. These include new metallic materials, metal matrix composites and resin matrix composites. It is believed that improved aluminum alloys and carbon fiber composites will dominated aircraft structural materials in the coming decades. While composites will be used in increased percentages as aircraft structural materials, new lightweight aluminum alloys, and especially aluminum-lithium alloys show great promise for extending the usefulness of aluminum alloys.

Heretofore, aluminum-lithium alloys have been used only sparsely in aircraft structure. The relatively low use has been caused by casting difficulties associated with aluminum-lithium alloys and by their relatively low fracture toughness compared to other more conventional aluminum alloys. Aluminum-lithium alloys, however, provide a substantial lowering of the density of aluminum alloys (as well as a relatively high strength to weight ratio), which has been found to be very important in decreasing the overall weight of structural materials used in an aircraft. While substantial strides have been made in improving the aluminum-lithium processing technology, a major challenge is still to obtain a good blend of fracture toughness and high strength in an aluminum-lithium alloy.

SUMMARY OF THE INVENTION

The present invention provides a novel aluminum alloy composition that can be worked and heat treated so as to provide an aluminum-lithium alloy with high strength, good fracture toughness, and relatively low density compared to conventional 2000 Series aluminum alloys that it is intended to replace. An alloy prepared in accordance with the present invention has a nominal composition on the order of 2.5 weight percent lithium, 1.0 percent magnesium, 1.6 percent copper and 0.12 percent zirconium. By underaging the alloy at a low temperature, an excellent blend of fracture toughness and high strength results.

DETAILED DESCRIPTION OF THE INVENTION

An aluminum-lithium alloy formulated in accordance with the present invention can contain from about 2.3 to about 2.7 percent lithium, 0.8 to 1.2 percent magnesium, 1.3 to 1.9 percent copper and a maximum of 0.15 percent zirconium as a grain refiner. Preferably from 0.1 to 0.15 percent zirconium is incorporated. All percentages herein are by weight percent based on the total weight of the alloy unless otherwise indicated. The magnesium is the alloy functions to increase strength and slightly decrease density. It also provides solid solution strengthening. The copper adds strength to the alloy. Zirconium functions as a preferred grain refiner.

Iron and silicon can each be present in maximums up to a total of 0.3 percent. It is preferred that these elements be present only in trace amounts, limiting the iron to a maximum of 0.15 percent and the silicon to a maximum of 0.12 percent, and most preferably to less than 0.10 percent and 0.10 percent, respectively. Certain trace elements such as zinc, may be present in the amounts up to, but not to exceed, 0.25 percent of the total. Other elements usch as chromium and manganese must be held to levels of 0.05 percent or below. If the maximums of these trace elements are exceeded, the desired properties of the aluminum-lithium alloy will tend to deteriorate. The trace elements sodium and hydrogen are also thought to be harmful to the properties (fracture toughness in particular) of aluminum-lithium alloys and should be held to the lowest levels practically attainable, for example on the order of 15 to 30 ppm (0.0015–0.0030 wt. %) for the sodium and less than 15 ppm (0.0015 wt. %) and preferably less than 1.0 ppm (0.0001 wt. %) for the hydrogen. The balance of the alloy, of course, comprises aluminum.

An aluminum-lithium alloy formulated in the proportions set forth in the foregoing paragraph is processes into an article utilizing known techniques. The alloy is formulated in molten form and cast into an ingot. The ingot is then homogenized at temperatures ranging from 925° F. to 1000° F. thereafter, the alloy is converted into a usable article by conventional mechanical formation techniques such as rolling, extrusion or the like. Once an article is formed, the alloy is normally subjected to a solution treatment at temperatures ranging from 950° F. to 1000° F., quenched in a quenching medium such as water that is maintained at a temperature on the order of 70° F. to 150° F. If the alloy has been rolled or extruded, it is generally stretched on the order of 1 to 3 percent of its original length to relieve internal stresses.

The aluminum alloy can then be further worked an formed into the various shapes for its final application. Additional heat treatments such as solution heat treatment can be employed if desired. For example, an extruded product after being cut to desired length is generally solution heat treated at temperatures on the order of 975° F. for 1 to 4 hours. The product is then quenched in a quenching medium held at temperatures ranging from about 70° F. to 150° F.

Thereafter, in accordance with the present invention, the article is preferably subjected to an aging treatment that will increase the strength of the material, while maintaining its fracture toughness and other engineering properties at relatively high levels. In accordance with the present invention, the articles are subjected to a low temperature underage heat treatment at temperatures ranging from about 200° F. to about 300° F. It is preferred that the alloy be heat treated in the range of from about 250° F. to 275° F. At the higher temperatures, less time is needed to bring about the proper balance between strength and fracture toughness than at lower aging temperatures, but the overall property mix will be slightly less desirable. For example, when the aging is conducted at temperatures on the order of 275° F. to 300° F., it is preferred that the product be subjected to the aging temperature for periods of from 1 to 40 hours. On the other hand, when aging is conducted at temperatures on the order of 250° F. or below, aging times from 2 to 80 hours or more are preferred to bring about the proper balance between fracture toughness and strength. After the aging treatment, the aluminum-lithium articles are cooled to room temperature.

When the low temperature underaging treatment is conducted in accordance with the parameters set forth above, the treatment will result in an aluminum-lithium alloy having an ultimate strength on the order of 65 to 70 ksi. The fracture toughness of the material, however, will be on the order of 1½ to 2 times greater than that of similar aluminum-lithium alloys subjected to conventional aging treatments, which are normally conducted at temperatures greater than 300° F. The superior strength and toughness combination achieved by the low temperature underaging techniques in accordance with the present invention also surprisingly causes some aluminum-lithium alloys to exhibit an improvement in stress corrosion resistance when contrasted with the same alloy aged with standard aging practices. Examples of these improved characteristics will be set forth in more detail in conjuction with the ensuing example.

EXAMPLE

The following example is presented to illustrate the superior characteristics of an aluminum-lithium alloy aged in accordance with the present invention and to assist one of ordinary skill in making and using the present invention. Moreover, it is intended to illustrate the significantly improved and unexpected characteristics of an aluminum-lithium alloy formulated and manufactured in accordance with the parameters of the present invention. The following example is not intended in any way to otherwise limit the scope of this disclosure or the protection granted by Letters Patent hereon.

An aluminum alloy containing 2.5 percent lithium, 1.0 percent magnesium, 1.6 percent copper, 0.15 percent zirconium with the balance being aluminum was formulated. The trace elements present in the formulation constituted less than about 0.25 percent of the total. The iron and silicon present in the formulation constituted less than 0.07 each percent of the formulation. The alloy was cast and homogenized at about 975° F. Thereafter, the alloy was hot rolled to a thickness of 0.2 thickness. The resulting sheet was then solution treated at about 975° F. for about 1 hour. It was then quenched in water maintained at about 70° F. Thereafter, the sheet was subjected to a stretch of 1½ percent of its initial length and then cut into specimens. The specimens were cut to a size of 0.5 inch by 2½ inch by 0.2 inch for the precrack Charpy impact tests, one method of measuring fracture toughness. The specimens prepared for the tensile strength tests were 1 inch by 4 inches by 0.2 inches. A plurality of specimens were then aged for 16 to 40 hours at 275° F., and at 250° F. for 40 and 72 hours. Specimens aged at each of the temperatures and times were then subjected to the tensile strength and precrack Charpy impact tests in accordance with standard testing procedures.

The specimens underaged at 275° F. had ultimate strengths ranging from about 65 ksi to about 70 ksi with the toughness on the order of 650 to 750 in-lbs/in$^2$. The specimens at 250° F. exhibited an ultimate strength ranging from 62 to 65 ksi, with the toughness in the range of 750 to 850 in-lbs/in$^2$. These values compared with toughness values less than about 450 in-lbs/in$^2$ for similar materials aged at temperatures over 300° F., yet having similar ultimate strengths.

The present invention has been described in relation to various embodiments, including the preferred formulation and processing parameters. One of ordinary skill after reading the foregoing specification will be able to effect various changes, substitutions of equivalents and other alterations without departing from the broad concepts disclosed herein. It is therefore intended that the scope of the Letters Patent granted hereon will be limited only by the definition contained in the appended claims and equivalents thereof.

The embodiments of the invention in which an exclusive property or privilege is claimed are defined as follows:

1. An aluminum-lithium ingot metallurgy alloy exhibiting good fracture toughness consisting essentially of

| Element | Amount (wt. %) |
|---|---|
| Li | 2.3 to 2.7 |
| Mg | 0.8 to 1.2 |
| Cu | 1.3 to 1.9 |
| Zr | 0.15 max |
| Fe | 0.15 max |
| Si | 0.12 max |
| Other trace elements | 0.25 max |
| Al | Balance. |

2. The alloy of claim 1 wherein said zirconium is present in amounts up to about 0.10 percent.

3. The alloy of claim 1 having a nominal composition of 2.5 percent lithium, 1.0 percent magnesium, and 1.6 percent copper.

4. The alloy of claim 1 wherein said alloy has been aged at a relatively low temperature for a relatively long time.

5. The alloy of claim 1 wherein said alloy has been aged at a temperature in the range of from 200° F. to 300° F.

6. The alloy of claim 5 wherein said alloy has been aged for a period of at least one hour.

7. The alloy of claim 1 wherein said alloy has been aged at a temperature of less than 275° F.

8. The alloy of claim 7, wherein said alloy has been aged for at least two hours.

9. The alloy of claim 1 wherein said alloy has been aged at a temperature of less than 250° F.

10. The alloy of claim 9 wherein said alloy has been aged for at least four hours.

* * * * *

UNITED STATES PATENT AND TRADEMARK OFFICE

CERTIFICATE OF CORRECTION

PATENT NO. : 4,735,774

DATED : April 5, 1988

INVENTOR(S) : Narayanan et al.

It is certified that error appears in the above-identified patent and that said Letters Patent is hereby corrected as shown below:

TITLE OF INVENTION: Delete "(4)"

Column 2, line 41: "usch" should be --such--

Column 2, line 55: "processes" should be --processed--

Column 2, line 59: "thereafter" should be -- Thereafter--

Column 3, line 1: "an" should be --and--

Column 3, line 49: "conjuction" should be --conjunction--

Column 4, line 3: "thickness" (second occurrence) should be --inches--

Column 4, line 13: "to" should be --and--

Signed and Sealed this

Fourth Day of October, 1988

*Attest:*

*Attesting Officer*

DONALD J. QUIGG

*Commissioner of Patents and Trademarks*